United States Patent [19]

Race

[11] 4,330,118

[45] May 18, 1982

[54] JUMP ROPE

[76] Inventor: Donald P. Race, 9151 S. Waterford Sq., Greenfield, Wis. 53228

[21] Appl. No.: 240,883

[22] Filed: Mar. 5, 1981

[51] Int. Cl.[3] ..... A63B 5/20

[52] U.S. Cl. ..... 272/75

[58] Field of Search ..... 272/75, 74; 46/1 G

[56] References Cited

U.S. PATENT DOCUMENTS

| | | | |
|---|---|---|---|
| 932,331 | 8/1909 | Russell et al. | 272/75 X |
| 964,623 | 7/1910 | Deckman | 272/75 |
| 1,629,209 | 5/1927 | Fairbanks | 272/75 |

FOREIGN PATENT DOCUMENTS

| | | | |
|---|---|---|---|
| 6467 | of 1909 | United Kingdom | 272/75 |
| 382807 | 11/1932 | United Kingdom | 272/75 |

*Primary Examiner*—Richard J. Apley
*Assistant Examiner*—Arnold W. Kramer
*Attorney, Agent, or Firm*—Richard P. Ulrich

[57] ABSTRACT

An improved jump rope has handles each removable from an associated conical fastener with the conical fastener having an outer shell, one portion of which is a hollow cylinder with the remainder the frustum of a hollow cone. An inner race is concentrically located inside the outer shell and is longitudinally movable. A plurality of balls are uniformly spaced around the circumference of the inner race to form a ring with the balls being free to move radially. A coil spring located in the hollow cylinder and wrapped around the inner race urges the inner race and balls towards the conical portion of the outer shell. A jump cable is attached at each end to an angled tube having flares on each end. The flare on the handle end of the tube may be inserted through the ring of balls or removed therefrom by compressing the spring so that the balls can move radially outward as the inner race is forced inwardly against the action of the spring. A spring surrounds each end of the jump cable and is attached to the flared end of the tube where the cable joins the tube.

2 Claims, 2 Drawing Figures

JUMP ROPE

BACKGROUND AND SUMMARY OF THE INVENTION

This invention relates to jump ropes having ball bearing assemblies in the handles. There has been a substantial demand created for jump ropes by persons who use them as an exercising aid or tool and also by persons who want to enter rope jumping contests. Jump ropes have become more sophisticated over the years. With the recent emphasis on exercise, many jump ropes have been made which use ball bearings in the handles to increase jump rate and keep the rope from twisting while in use. Thus the demand is not for toy ropes or ropes for children but rather ropes which are substantial and suitable for use by adults under strenuous conditions.

In the course of jumping, the ropes are subject to wear. Since much of the cost of high quality ball bearing jump ropes is in the handles, it is desirable to provide for easy replacement of the rope itself. My invention does this and still retains the quality demanded by the user. None of the devices of which I am aware can be easily disassembled.

Therefore, it is an object of my invention to provide a device which can be disassembled easily.

When using a jump rope, the handles are held in a position which is substantially horizontal. Since the rope, as it emerges from the handle, rotates in an almost vertical plane when in use, the rope tends to wear rapidly at the point at which it emerges from the handle. To eliminate or reduce this problem, I use a piece of tubular steel which is bent at an angle of approximately 45 degrees. The tube is attached to the rope on one end and rides on the balls on the other end. The angle of the steel tube provides a near vertical connection for the rope. In addition, I use springs around the ends of the rope at the point of attachment to the tubes to insure that the rope will not kink at the point where it emerges from the tubes.

Therefore, it is another object of this invention to reduce the wear on the rope at the points where it emerges from the handles.

DESCRIPTION OF THE PREFERRED EMBODIMENT

Figure 1:
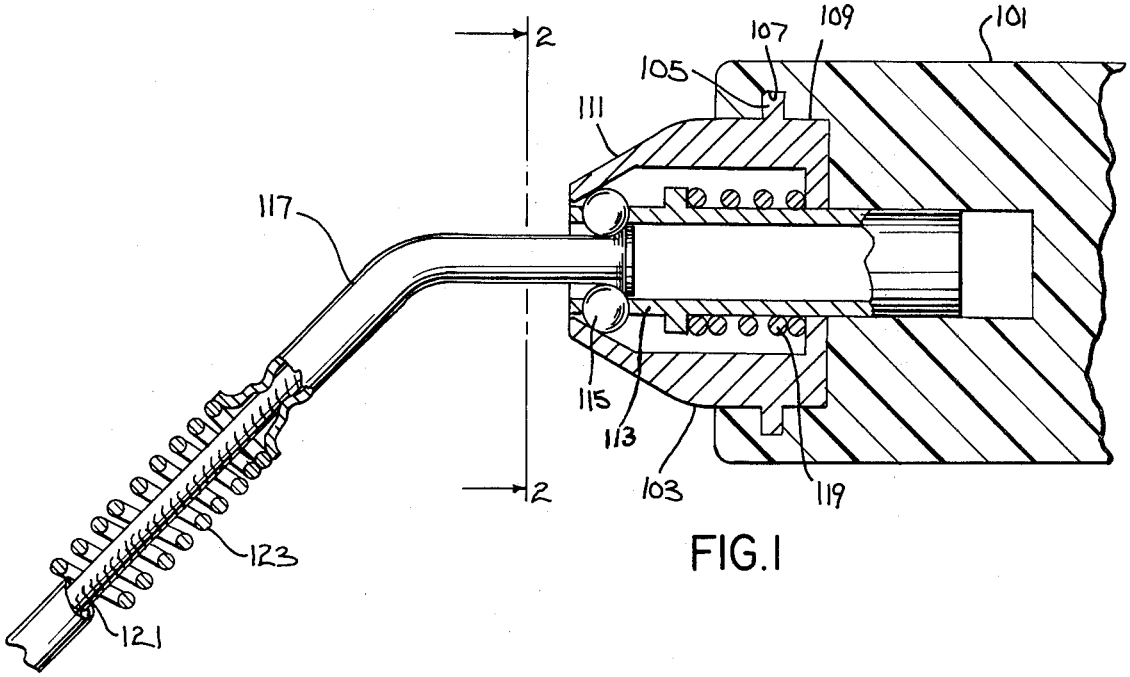
FIG. 1 is a side view partially in section of the device.
Figure 2:
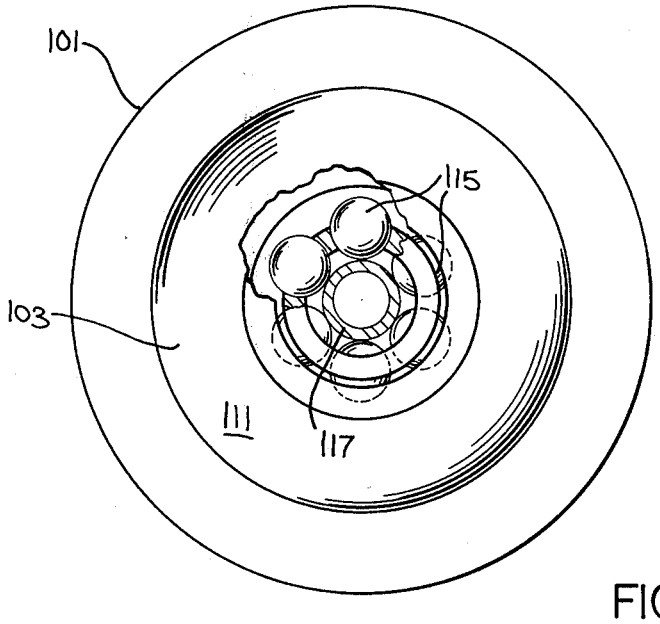
FIG. 2 is an end view of the conical fastener taken in the direction of the arrows on line 2—2 in FIG. 1.

With reference to the drawings. Handle 101, may be attached to conical fastener 103 by inserting tongue 105 in groove 107. In the preferred embodiment, handle 101 is made of a plastic material which is sufficiently flexible so that groove 107 may be slipped over tongue 105. Although this method of attachment is simple, any other method such as internal threads on the handles and external threads on the fasteners may be used.

Although the shell of conical fastener 103 is made from a single piece of metal, it may be considered to comprise a hollow cylindrical portion 109 and a hollow conical portion 111. The inner surface of the conical portion also acts as the outer race of a ball bearing assembly. Inner race 113 of the ball bearing assembly is concentrically located within the shell of fastener 103. A plurality of balls 115 are located at even intervals around the circumference of inner race 113. Balls 115 are free to move radially outward until they touch the inner wall of the shell. Spring 119, which is wrapped around the right end portion of inner race 113, urges inner race 113 to the left. Since the left end of the shell is conical, the circumference of the ring of balls decreases as the inner race moves leftward.

Tubing 117 is flared at both ends and bent to approximately a 45 degree angle at a point intermediate its ends. This angle is not critical. It could be greater than or less than 45 degrees if desired. Cable 121 is attached to a first end of tubing 117 by crimping or other suitable means. The inner diameter of race 113 is made sufficiently large so that the second end of tubing 117 will slide into it and through the ring of balls. In order to provide sufficient clearance for the passage of the second end of tubing 117, inner race 113 must be moved to the right until the balls are in the cylindrical portion 109 of the shell. Inner race 113, will move leftward in response to the urging of spring 119 as soon as it is released.

Spring 123, is attached to the first end of tubing 117 and surrounds the end portion of cable 121. Spring 123 insures that cable 121 will not kink at the point where cable 121 emerges from tubing 117.

Cables and handles may be assembled separately. After assembly, the cable and handles are joined by inserting tubing 117 into inner race 113 and through the ring of balls. The balls become wedged between the inner surface of conical portion 111 and the outer flared surface of tubing 117 in response to any attempt to remove tubing 117 from fastener 103 by pulling the two apart. To separate the two, inner race 113 must be moved to the right until the circumference of the ring of balls enlarges enough to allow removal of tubing 117.

What is claimed is:

1. A jump rope comprising:

a. a pair of removable handles;

b. a pair of conical fasteners each comprising:

1. an outer shell, one portion of which is a hollow cylinder and the other portion of which is the frustum of a hollow cone;
2. an inner race which is concentrically located inside the outer shell, said race being movable longitudinally;
3. a plurality of balls uniformly spaced around the circumference of the inner race forming a ring, said balls being free to move radially; and
4. spring means for urging the inner race toward the conical portion of the outer shell;

c. a pair of tubes, each having flares on both ends, and having an angle at a point intermediate its ends, said tube having a first end which may be inserted through the ring of balls or removed therefrom; and d. cable means attached to a second end of each tube.

2. The jump rope as claimed in claim 1 which further comprises spring means surrounding the ends of the cable and attached to the second end of each tube.

* * * * *